US011794501B2

(12) United States Patent
Nishijima

(10) Patent No.: US 11,794,501 B2
(45) Date of Patent: Oct. 24, 2023

(54) PRINTING DEVICE WITH LIGHTED ICON INDICATORS PROVIDED IN AN OPENING/CLOSING COVER

(71) Applicant: SEIKO EPSON CORPORATION, Tokyo (JP)

(72) Inventor: Hideaki Nishijima, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 17/648,185

(22) Filed: Jan. 18, 2022

(65) Prior Publication Data

US 2022/0227151 A1 Jul. 21, 2022

(30) Foreign Application Priority Data

Jan. 19, 2021 (JP) ..... 2021-006188

(51) Int. Cl.
*B41J 29/393* (2006.01)
*B41J 29/42* (2006.01)
*B41J 29/13* (2006.01)

(52) U.S. Cl.
CPC ..... *B41J 29/393* (2013.01); *B41J 29/13* (2013.01); *B41J 29/42* (2013.01)

(58) Field of Classification Search
None
See application file for complete search history.

(56) References Cited

U.S. PATENT DOCUMENTS

2016/0159275 A1* 6/2016 Ito ..... B60K 37/02 362/509
2017/0080718 A1* 3/2017 Nohara ..... B41J 11/0095
2017/0308013 A1* 10/2017 Buthrath ..... B41J 15/042
2019/0308430 A1* 10/2019 Akahane ..... B41J 3/46

FOREIGN PATENT DOCUMENTS

JP H04-104689 4/1992
JP H07-010782 1/1995
JP 2008-242170 10/2008
JP 2015-028435 A 2/2015

* cited by examiner

*Primary Examiner* — Miya J Cato
*Assistant Examiner* — Pawan Dhingra
(74) *Attorney, Agent, or Firm* — WORKMAN NYDEGGER

(57) ABSTRACT

A printing device according to the present disclosure includes: a device body; an opening/closing cover pivotably provided on the device body; a plurality of light sources provided on the device body; a plurality of icon indicators provided in the opening/closing cover at positions corresponding to the plurality of light sources when the opening/closing cover is closed; first light-shielding portions provided on the opening/closing cover at positions between the plurality of icon indicators; and second light-shielding portions provided on the device body at positions between the plurality of light sources.

13 Claims, 9 Drawing Sheets

PRINTING DEVICE WITH LIGHTED ICON INDICATORS PROVIDED IN AN OPENING/CLOSING COVER

The present application is based on, and claims priority from JP Application Serial Number 2021-006188, filed Jan. 19, 2021, the disclosure of which is hereby incorporated by reference herein in its entirety.

BACKGROUND

1. Technical Field

The present disclosure relates to a printing device.

2. Related Art

JP-A-2015-028435 discloses a display device with multiple indicators, multiple light sources provided so as to correspond to the multiple indicators, and light-shielding members. The light-shielding members are provided so as to extend from portions between the multiple light sources to portions between the multiple indicators to prevent leakage of exit light coming from the light sources into adjoining indicators. The indicators, the light sources, and the light-shielding members are formed as a single component.

In a structure in which the light sources are provided on a device body, and the indicators are provided on an opening/closing cover, unlike the structure as in this display device, in which the indicators, the light sources, and the light-shielding members are formed as a single component, it is difficult to provide the light-shielding members extending from the portions between the multiple light sources to the portions between the multiple indicators. Hence, depending on the arrangement and structure of the light-shielding members, the exit light coming from the light sources may leak out into adjoining indicators.

SUMMARY

According to an aspect of the present disclosure, there is provided a printing device including: a device body; an opening/closing cover pivotably provided on the device body; a plurality of light sources provided on the device body; a plurality of icon indicators provided in the opening/closing cover at positions corresponding to the plurality of light sources when the opening/closing cover is closed; first light-shielding portions provided on the opening/closing cover at positions between the plurality of icon indicators; and second light-shielding portions provided on the device body at positions between the plurality of light sources.

DESCRIPTION OF EXEMPLARY EMBODIMENTS

Referring to the attached drawings, an embodiment of a printing device will be described. A printing device 1 according to this embodiment is used as, for example, a receipt printer in a point-of-sales (POS) system. Although directions according to the XYZ orthogonal coordinate system, indicated in each drawing, will be used in the description below, such directions are only for ease of explanation and will not limit the embodiment below. In FIGS. 1 to 4, the vertical direction is the Z direction, and in FIGS. 5 to 9, the direction perpendicular to a substrate 61 shown in FIG. 5 is the Z direction. The numbers of components are merely an example and will not limit the embodiment below.

Exterior Structure of Printing Device

Figure 1:
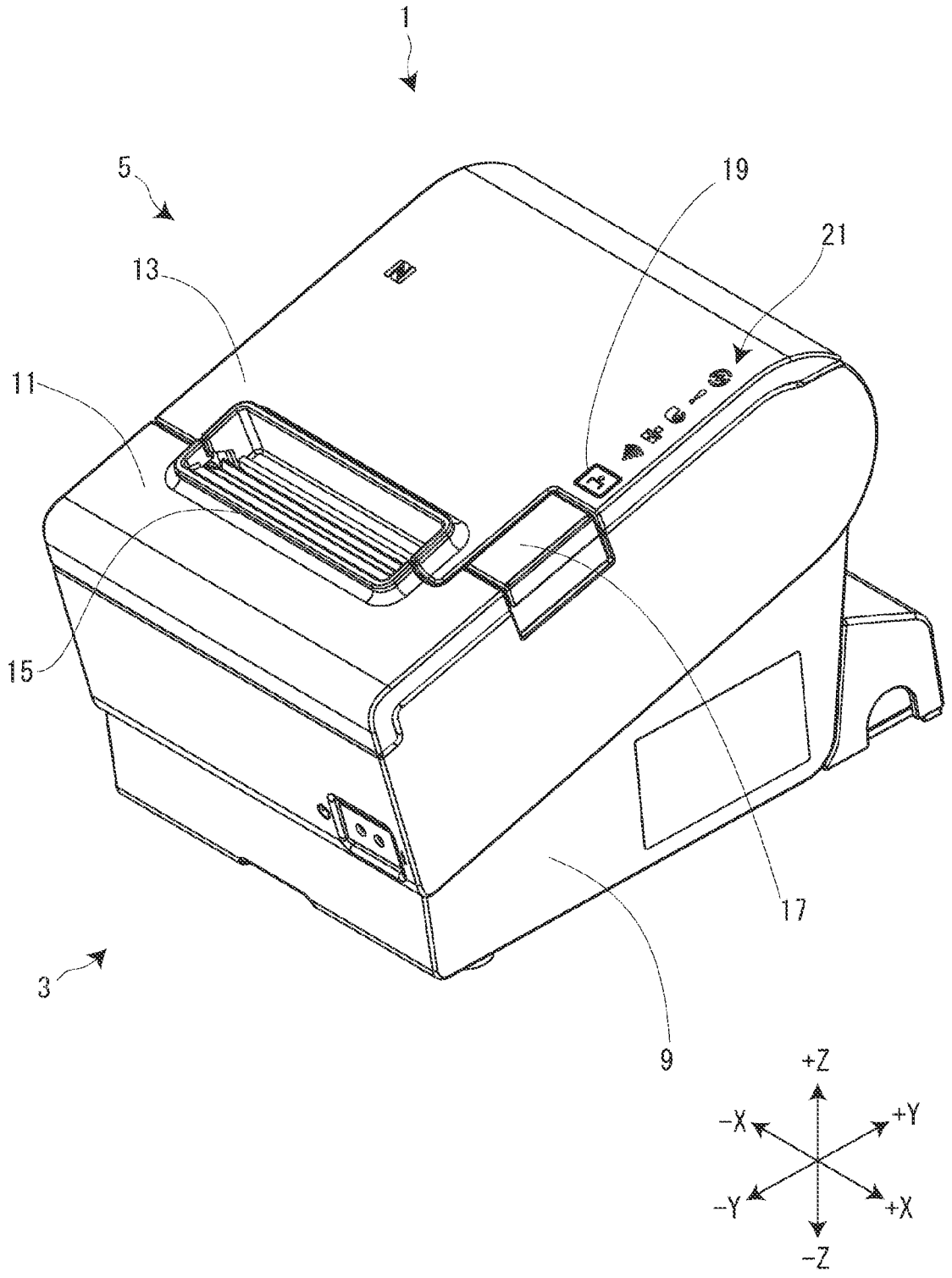
FIG. 1 is a perspective view of a printing device with an opening/closing cover closed.
Figure 2:
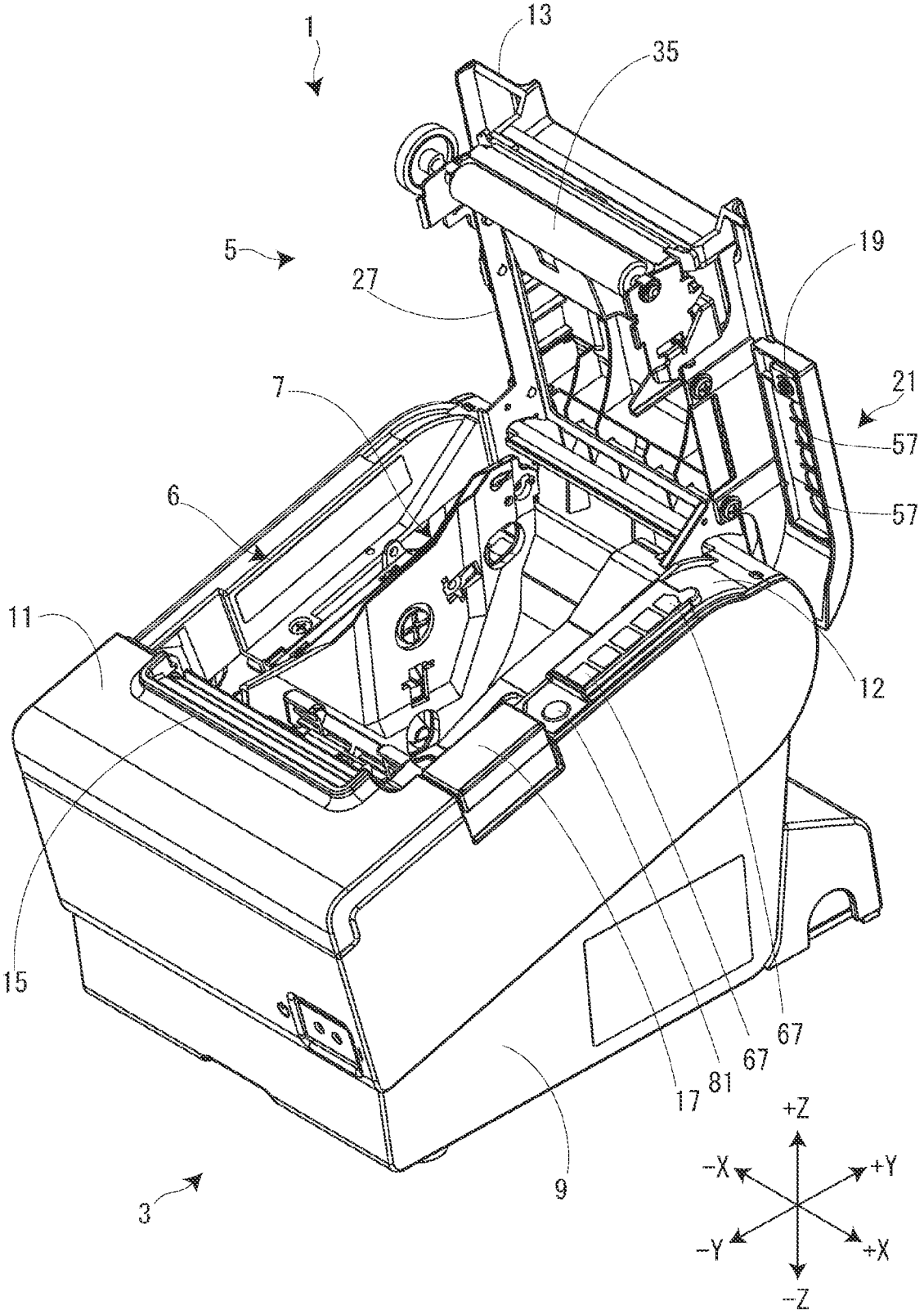
FIG. 2 is a perspective view of the printing device with the opening/closing cover open.

Referring to FIGS. 1 and 2, the exterior structure of the printing device 1 will be described. The printing device 1 includes a device body 3 and an opening/closing cover 5. The device body 3 has a substantially rectangular parallelepiped shape having an opening 6 in the +Z-side face. The device body 3 has a roll-paper storage portion 7 inside. The roll-paper storage portion 7 accommodates roll paper R, which is recording paper P, serving as a printing medium, wound in a roll shape (see FIG. 3). The opening/closing cover 5 is pivotably attached to the +Y-side end of the device body 3 and opens or closes the opening 6.

The exterior of the printing device 1 includes a body exterior portion 9, a cutter cover 11, an opening exterior portion 12, and a cover exterior portion 13.

The body exterior portion 9, the cutter cover 11, and the opening exterior portion 12 constitute the exterior of the device body 3. The body exterior portion 9 has a substantially rectangular parallelepiped box shape with the +Z-side face open. The cutter cover 11 is provided to the −Y side of the opening/closing cover 5. Opening the cutter cover 11 exposes an auto cutter 37 (see FIG. 3, described below). An output port 15 is provided at the boundary between the cutter cover 11 and the opening/closing cover 5. The recording paper P fed from the roll paper R accommodated in the roll-paper storage portion 7 is output from the output port 15. The opening exterior portion 12 is provided at an edge of the opening 6. The cover exterior portion 13 constitutes the exterior of the opening/closing cover 5.

The printing device 1 also includes a cover opening button 17, a feed button 19, and a panel portion 21. The cover opening button 17, the feed button 19, and the panel portion 21 are provided at the +X-side end of the +Z-side face of the printing device 1.

Pressing the cover opening button 17 opens the opening/closing cover 5. Pressing the feed button 19 rotates a platen roller 35 (described below) to feed the recording paper P toward the output port 15. The panel portion 21 displays various information, including error information, to a user.

Internal Structure of Printing Device

Figure 3:
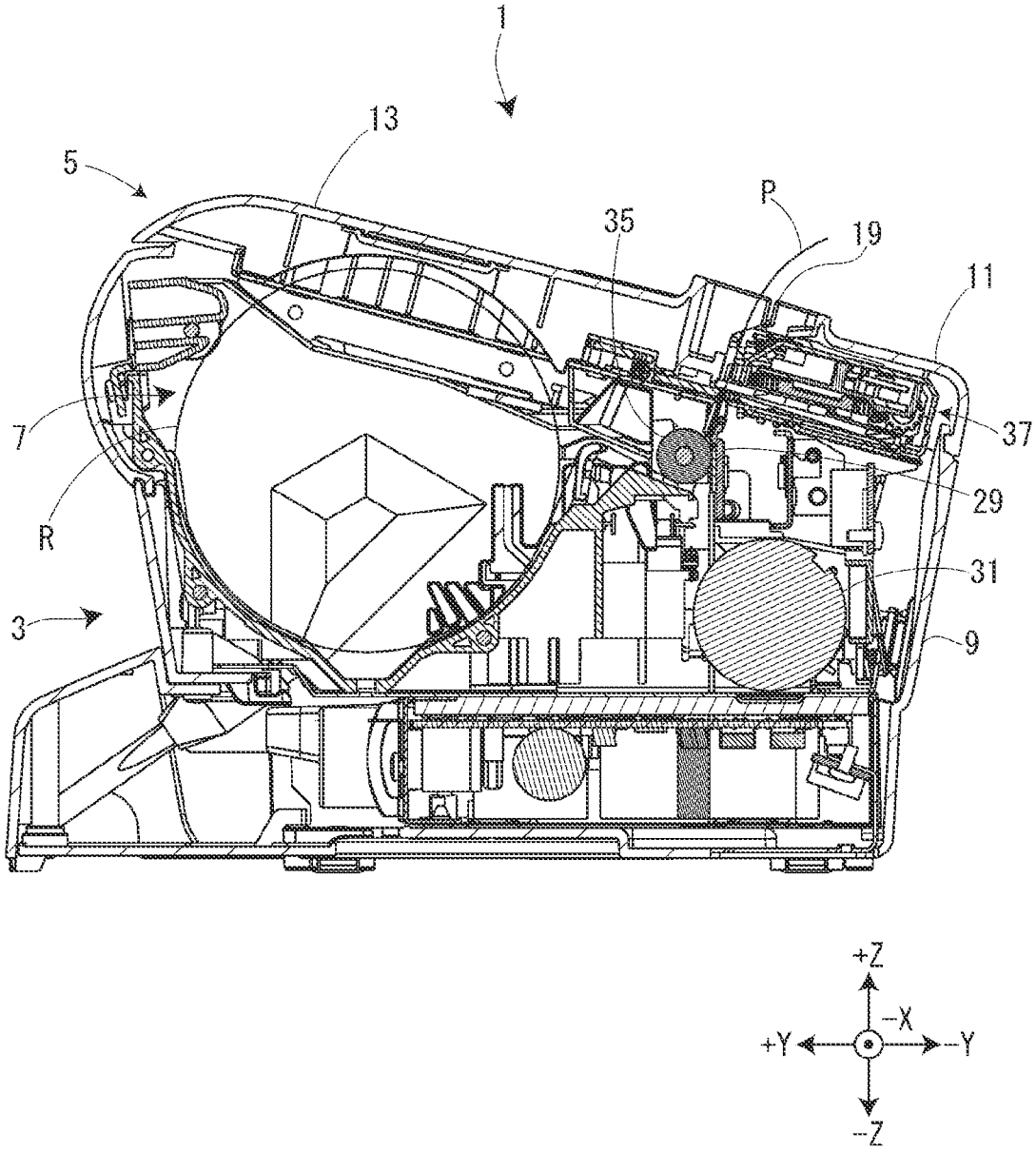
FIG. 3 is a sectional view of the printing device.
Figure 4:
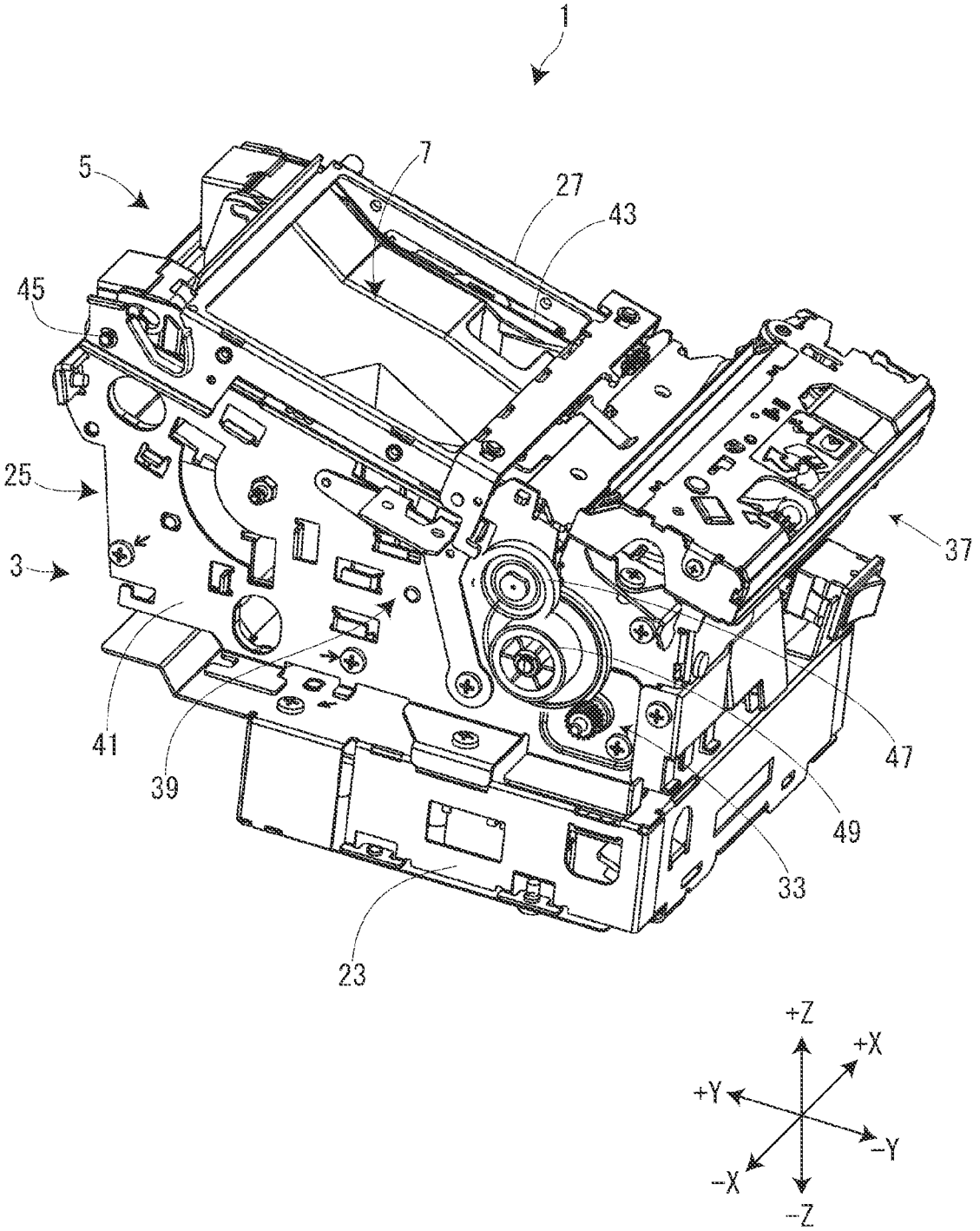
FIG. 4 is a perspective view showing the internal structure of the printing device.
Figure 5:
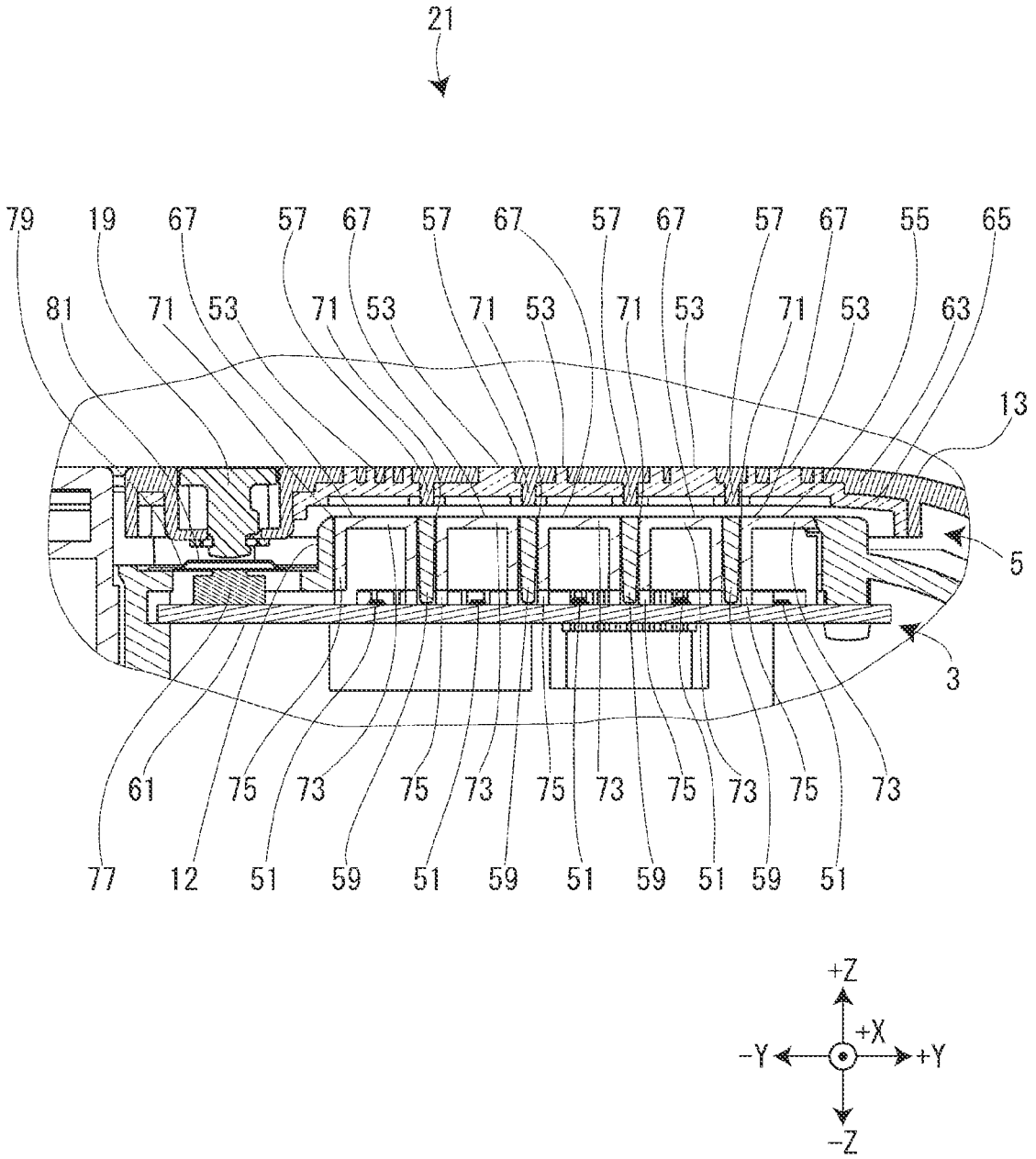
FIG. 5 is a sectional view of a panel portion with the opening/closing cover closed.

Referring to FIGS. 3 and 4, the internal structure of the printing device 1 will be described. The printing device 1 includes a base frame 23, a body frame 25, a cover frame 27, a thermal head 29, a feed motor 31, a gear train 33, a platen roller 35, the auto cutter 37, and a lock mechanism 39.

The base frame 23 and the body frame 25 are provided inside the body exterior portion 9. The base frame 23 supports the body frame 25. The body frame 25 includes a first body frame 41 and a second body frame 43. Both the first body frame 41 and the second body frame 43 have a substantially rectangular plate shape extending in the Y direction. The second body frame 43 is provided to the +X side of the first body frame 41. A cover support shaft 45 extending in the X direction is provided at the +Y-side ends of the first body frame 41 and the second body frame 43.

The cover frame 27 is provided inside the cover exterior portion 13. The cover frame 27 has a substantially rectangular frame shape and is pivotably supported by the body frame 25 via the cover support shaft 45. The cover frame 27 has, at the +Y-side end thereof, a cover-support-shaft hole (not shown) that receives the cover support shaft 45.

The thermal head 29 is supported by the body frame 25. The thermal head 29 has multiple heat-generating elements (not shown) and performs printing on the recording paper P fed out from the roll paper R.

The feed motor 31 is fixed to the −Y-side end of the first body frame 41. The feed motor 31 is a driving source for the platen roller 35. An example of the feed motor 31 is a direct-current (DC) motor.

The gear train 33 is provided on the first body frame 41. The gear train 33 includes multiple gears and transmits the power of the feed motor 31 to the platen roller 35.

The platen roller 35 is rotatably supported at the −Y-side end of the cover frame 27. The platen roller 35 makes contact with the thermal head 29 when the opening/closing cover 5 is closed. The platen roller 35 is urged toward the thermal head 29 by a roller spring (not shown). Hence, the platen roller 35 nips the recording paper P between itself and the thermal head 29. The platen roller 35 feeds the recording paper P nipped between itself and the thermal head 29 toward the output port 15. More specifically, when the platen roller 35 rotates, the recording paper P is fed out from the roll paper R toward the output port 15.

A roller gear 47 is provided to the −X side of the platen roller 35 so as to be coaxial with the platen roller 35. The roller gear 47 is in mesh with a transmission gear 49 of the gear train 33 and rotates with the platen roller 35.

The auto cutter 37 is provided between the platen roller 35 and the output port 15 and cuts the recording paper P, fed to the output port 15, in the X direction, i.e., the width direction of the recording paper P, at a position behind the printed portion. The auto cutter 37 cuts the recording paper P so as to leave an uncut portion at the −X-side end, so that the recording paper P after being cut remains at the output port 15.

Panel Portion

Referring to FIGS. 5 to 9, the panel portion 21 will be described. The panel portion 21 has five light sources 51, five icon indicators 53, a substrate cover 55, four first light-shielding portions 57, and four second light-shielding portions 59. The panel portion 21 displays various information to a user by selectively lighting the five icon indicators 53.

As shown in FIG. 5, the five light sources 51 are mounted side-by-side in the Y direction on the +Z-side face of the substrate 61. The optical axis direction of the exit light L (see FIG. 9) emitted from the light sources 51 is the +Z direction, i.e., a direction substantially perpendicular to the substrate 61. Reference signs La, Lb, Lc and Ld shown in FIG. 9 all represent the exit light L, and among them, the reference sign Ld represents the optical axis of the exit light L. Examples of the light sources 51 include light emitting diode (LED) lamps.

The substrate 61, on which the five light sources 51 are mounted, is located to the +X side of the opening 6 (see FIG. 2) and is attached to the inside of the opening exterior portion 12. The opening exterior portion 12 is formed of a non-transmissive material. Unlike the structure in this embodiment, in a structure in which the substrate 61 is provided on the opening/closing cover 5, a wire coupling the substrate 61 and the device body 3 is required. In this embodiment, because the substrate 61 is provided on the device body 3, such a wire is not required, thus achieving a simple structure.

Figure 6:
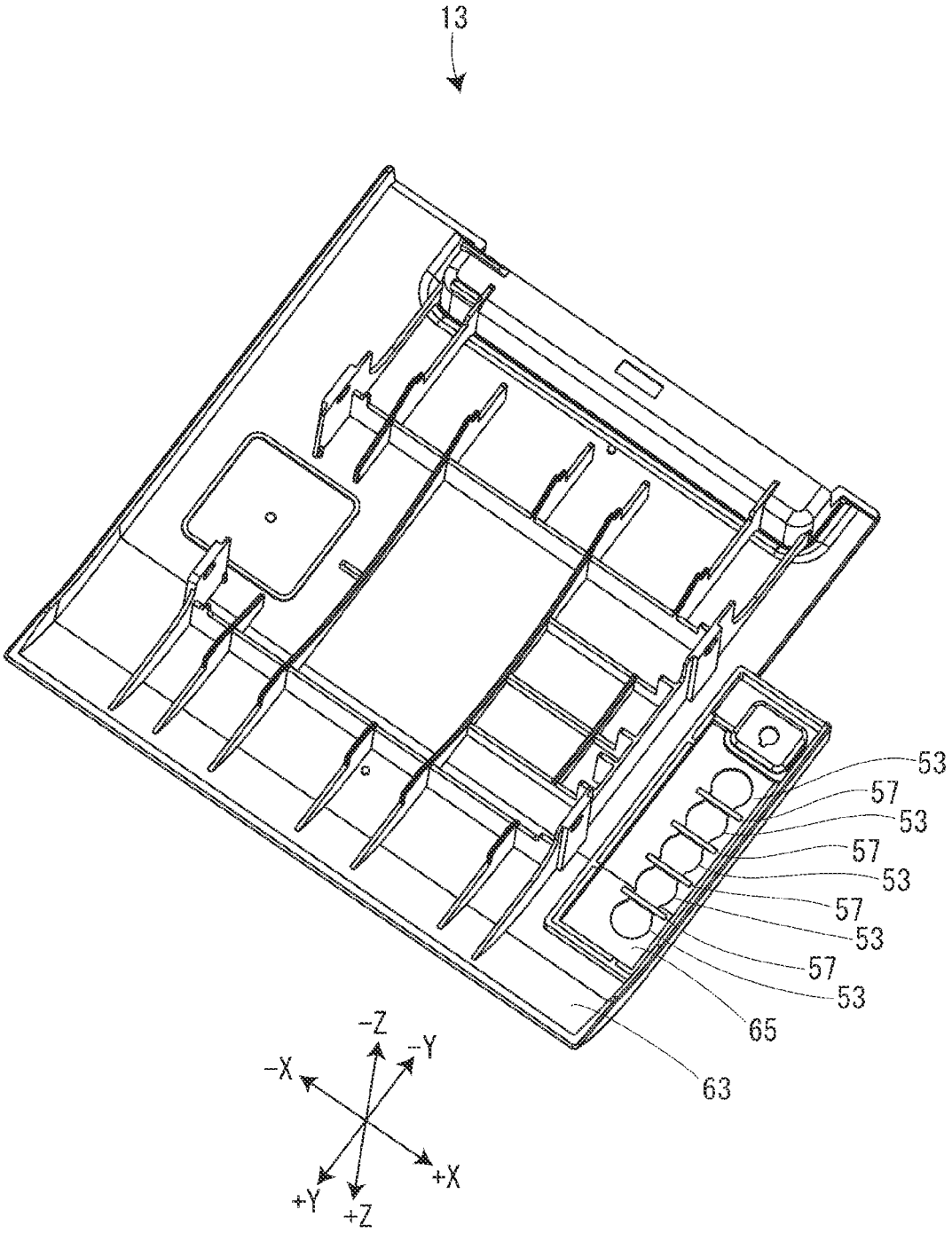
FIG. 6 is a perspective view of a cover exterior portion.

As shown in FIGS. 5 and 6, the five icon indicators 53 are provided side-by-side in the Y direction, at the +X-side end of the cover exterior portion 13. The five icon indicators 53 are located at positions corresponding to the five light sources 51 when the opening/closing cover 5 is closed. More specifically, the icon indicators 53 are located to the +Z side, i.e., in the optical axis direction of the light sources 51, with respect to the light sources 51.

Unlike the structure in this embodiment, in a structure in which the icon indicators 53 are provided on the device body 3, a gap is formed between the cover exterior portion 13 and the exterior portion having the icon indicators 53. The gap is likely to collect dust, such as grease, paper powder, etc. In contrast, in this embodiment, because the icon indicators 53 are provided on the cover exterior portion 13, such a gap is not formed, and hence, accumulation of dust on the exterior portion of the printing device 1 is suppressed. In other words, because the cover exterior portion 13 including the icon indicators 53 can be formed as a single surface, ease of cleaning and cleanliness are improved.

The five icon indicators 53 indicate, for example, ON/OFF of the power of the printing device 1, an error status of the printing device 1, the roll-end of the roll paper R accommodated in the roll-paper storage portion 7, and the status of communication between the printing device 1 and an external device.

The cover exterior portion 13 having the five icon indicators 53 has a non-transmissive portion 63 and a transmissive portion 65. The non-transmissive portion 63 is formed of a non-transmissive material and constitutes a large part of the cover exterior portion 13. The transmissive portion 65 is formed of a transmissive material and is provided at the +X-side end of the cover exterior portion 13. The transmissive portion 65 allows the exit light L emitted from the light sources 51 to pass therethrough and diffuse. The five icon indicators 53 are provided in the transmissive portion 65. In other words, the portions of the transmissive portion 65 that are not covered by the non-transmissive portion 63 are the icon indicators 53.

The non-transmissive portion 63 and the transmissive portion 65 are formed as a single component by means of, for example, double molding. Hence, there is no gap between the non-transmissive portion 63 and the transmissive portion 65, and thus, accumulation of dust on the cover exterior portion 13 does not occur.

Figure 7:
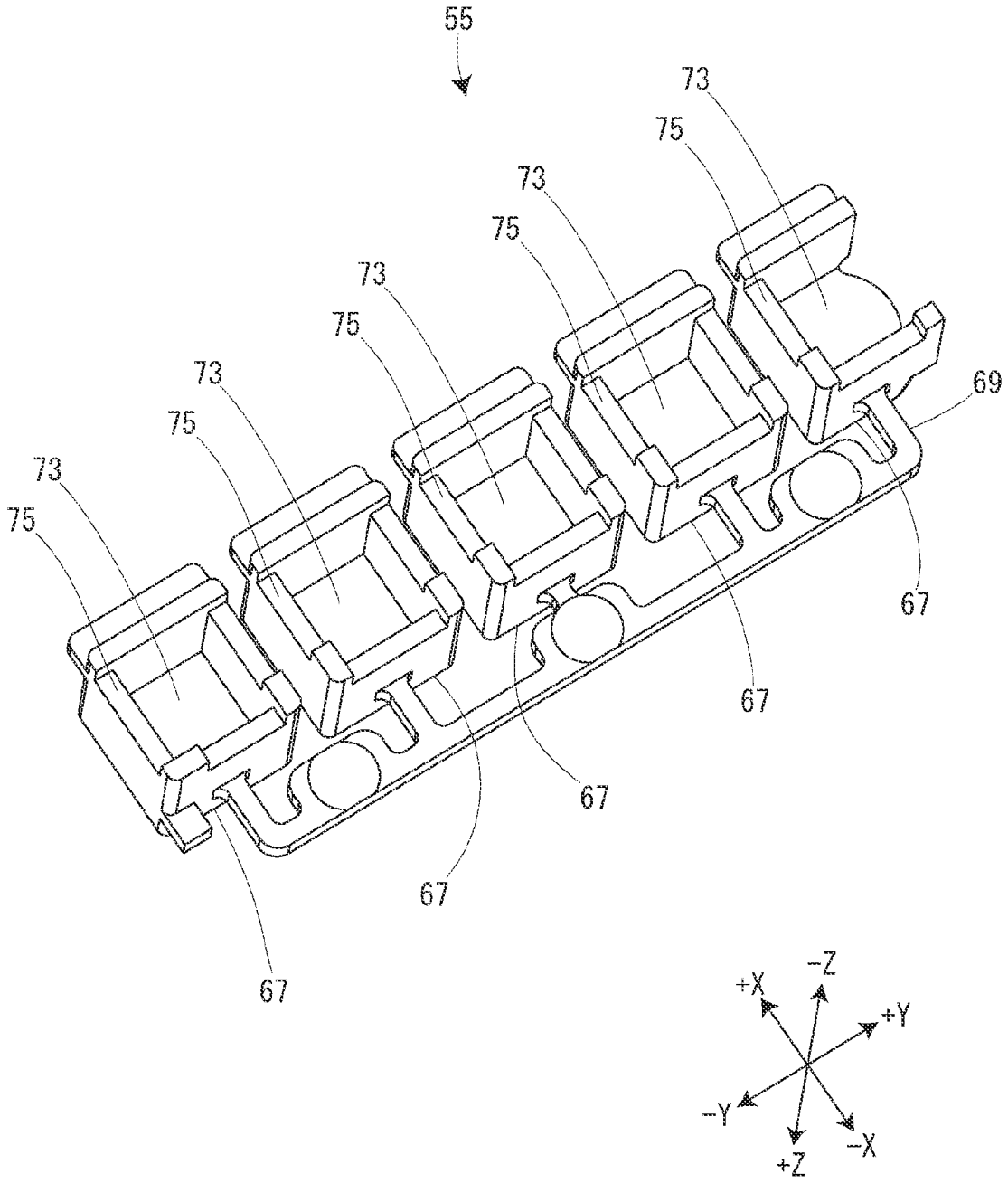
FIG. 7 is a perspective view of a substrate cover.
Figure 8:
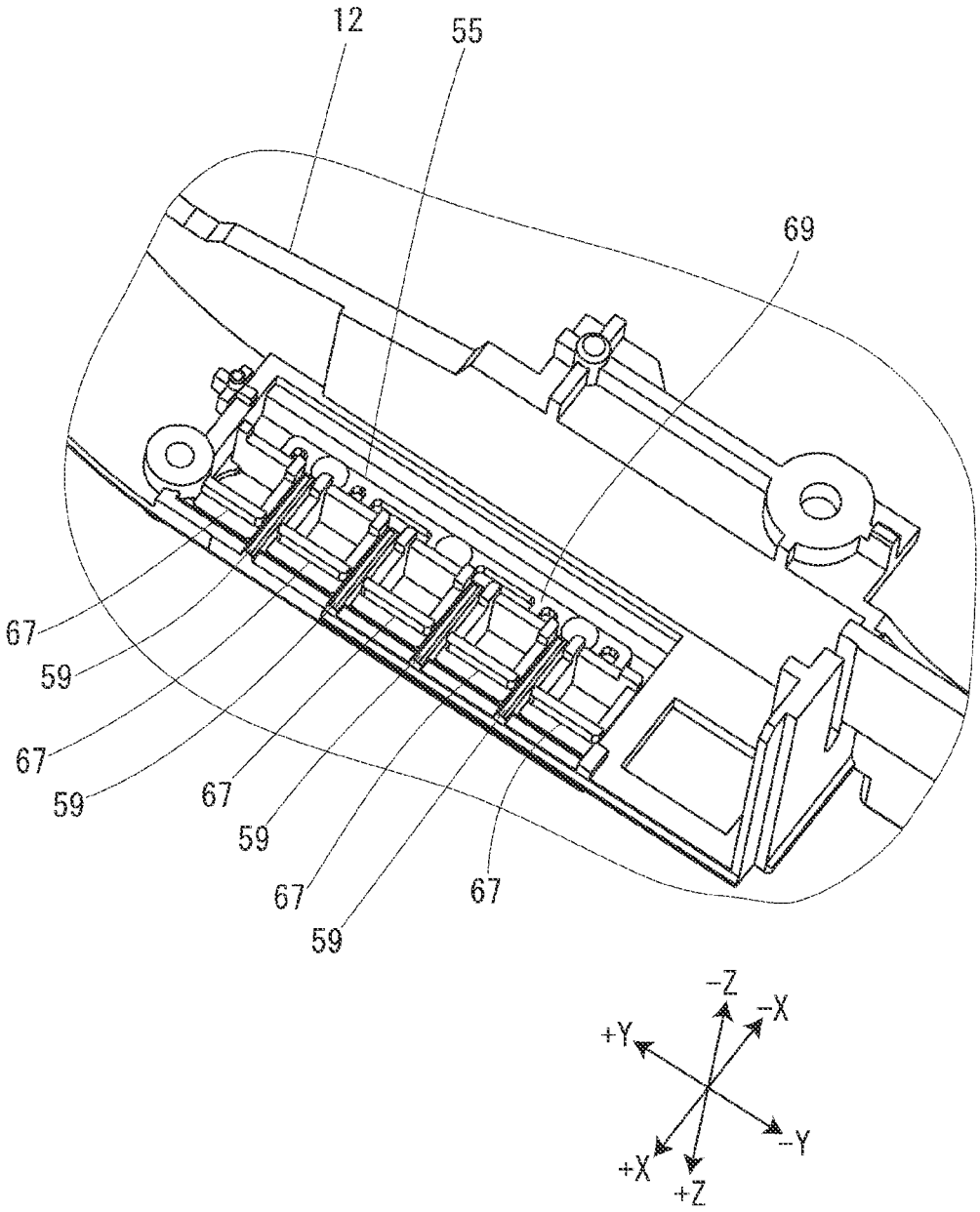
FIG. 8 is a partial enlarged view of an opening exterior portion with the substrate cover attached.

As shown in FIGS. 5, 7, and 8, the substrate cover 55 is provided between the opening exterior portion 12 and the substrate 61. The substrate cover 55 is formed of a transmissive material. The substrate cover 55 includes five cover portions 67 and a coupling portion 69.

The five cover portions 67 are provided side-by-side in the Y direction and cover the five light sources 51. The cover portions 67 each have a substantially rectangular parallelepiped shape having an opening in the −Z-side face, i.e., the face facing the substrate 61, and are provided so as to be fitted on the light sources 51 provided on the substrate 61.

Because the light sources 51 are covered by the cover portions 67, the entry of foreign matter into the light sources 51 is suppressed.

The opening exterior portion 12 has five cover openings 71 arranged side-by-side in the Y direction. The five cover portions 67 are fitted into the five cover openings 71. The +Z-side face of the opening exterior portion 12 and the +Z-side faces of the cover portions 67 are substantially in flush (see FIG. 5).

The cover portions 67 each have a first wall 73 and a second wall 75. The first wall 73 is a +Z-side wall of the cover portion 67 and is provided between the light source 51 and the icon indicator 53 so as to cover the cover opening 71. More specifically, the first wall 73 covers the +Z side of the light source 51. The first wall 73 has a substantially uniform thickness. The second wall 75 includes the +X-side wall, the −X-side wall, the +Y-side wall, and the −Y-side wall of the cover portion 67. The second wall 75 projects in the −Z direction toward the substrate 61 from the periphery of the first wall 73 so as to surround the light source 51. In other words, the second wall 75 surrounds the light source 51. Note that, among the five cover portions 67, the cover portion 67 located on the extreme+Y side has an opening in the +Y-side face.

The coupling portion 69 is provided to the −X side of the five cover portions 67 and couples the five cover portions 67 together. More specifically, the five cover portions 67 are formed as a single component via the coupling portion 69. The substrate cover 55 may not have the coupling portion 69, that is, the five cover portions 67 may be formed as separate components.

As shown in FIGS. 5 and 6, the four first light-shielding portions 57 are provided side-by-side in the Y direction, between the five icon indicators 53. The first light-shielding portions 57 are formed in a rectangular plate shape extending in the X direction. The first light-shielding portions 57 project in the −Z direction toward the substrate 61, from the inner surface, i.e., the −Z-side face, of the cover exterior portion 13. The first light-shielding portions 57 are formed of the non-transmissive portion 63 of the cover exterior portion 13. The first light-shielding portions 57 do not necessarily have to have a rectangular plate shape, but may have, for example, a tubular shape surrounding the icon indicators 53.

As shown in FIGS. 5 and 8, the four second light-shielding portions 59 are provided side-by-side in the Y direction, between the five light sources 51, i.e., the five cover portions 67. In other words, the substrate cover 55 is attached to the opening exterior portion 12 such that the second light-shielding portions 59 are inserted between the cover portions 67. The second light-shielding portions 59 are formed in a rectangular plate shape extending in the X direction. The second light-shielding portions 59 project in the −Z direction toward the substrate 61 from the inner surfaces, i.e., the −Z-side faces, of the wall portions between the cover openings 71 provided in the opening exterior portion 12. The second light-shielding portions 59 do not necessarily have to have a rectangular plate shape, but may have, for example, a tubular shape surrounding the light sources 51.

The first light-shielding portions 57 are located at positions corresponding to the second light-shielding portions 59 when the opening/closing cover 5 is closed. More specifically, the first light-shielding portions 57 are located to the +Z side, i.e., in the optical axis direction of the light sources 51, with respect to the second light-shielding portions 59.

As shown in FIG. 5, the substrate 61 has a switch member 77 to the −Y side of the five light sources 51. The switch member 77 is provided at a position corresponding to the feed button 19, which is provided on the opening/closing cover 5, when the opening/closing cover 5 is closed. The opening exterior portion 12 has a switch opening 79 at a position corresponding to the switch member 77. The switch opening 79 is covered by a flexible switch cover 81. When a user presses the feed button 19, the feed button 19 presses the switch member 77 via the switch cover 81. As a result, the switch member 77 is switched between ON and OFF. When the switch member 77 is switched to ON, the feed motor 31 is actuated to rotate the platen roller 35, thus feeding the recording paper P to the output port 15.

Because the switch member 77 is provided on the substrate 61, on which the light sources 51 are provided, there is no need to provide multiple substrates 61. Thus, a simple structure is achieved.

Figure 9:
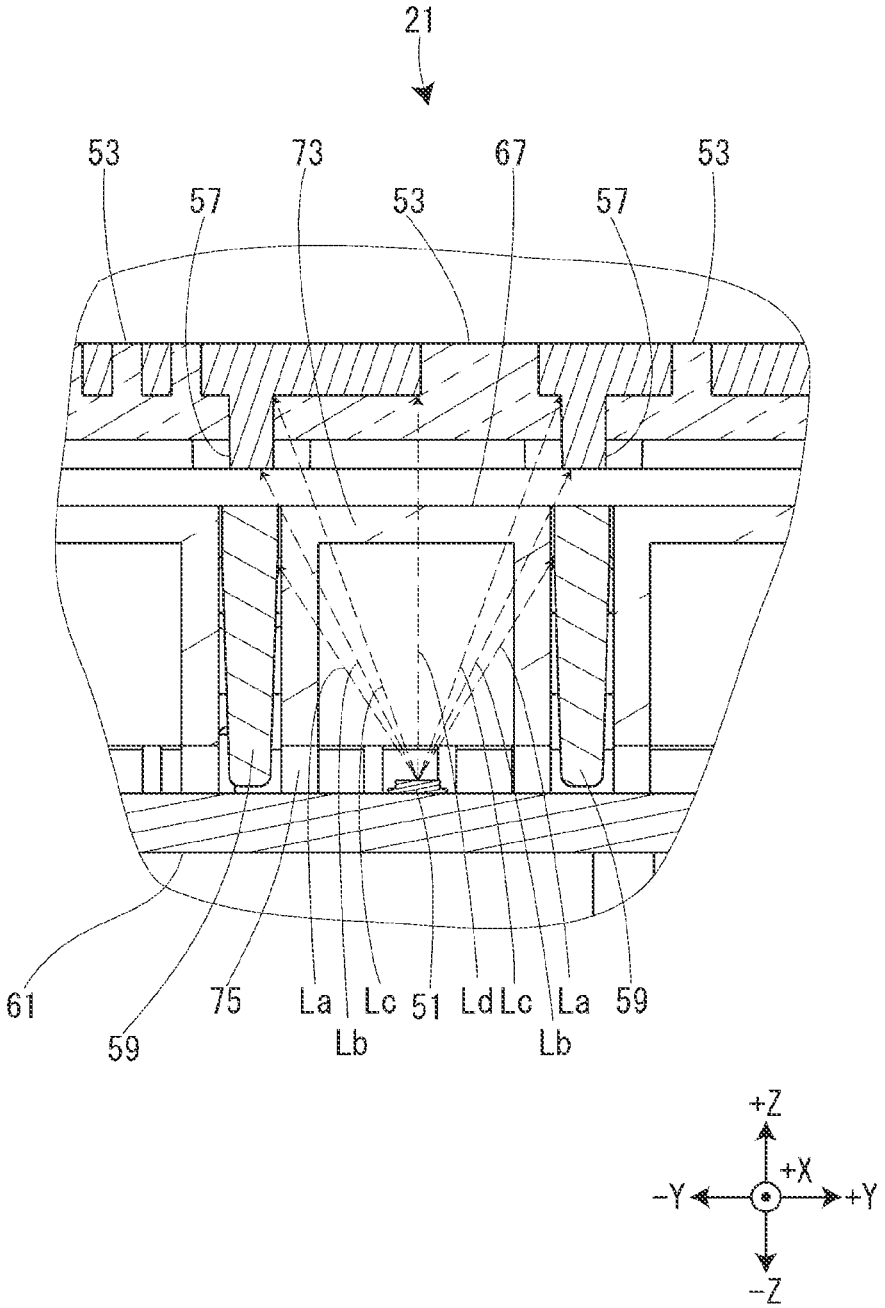
FIG. 9 is a partially enlarged sectional view of the panel portion with the opening/closing cover closed.

As shown in FIG. 9, the exit light L emitted from the light sources 51 is narrowed at the +Z-side ends of the second light-shielding portions 59. More specifically, in the exit light L, exit light La is blocked and inhibited from reaching adjoining icon indicators 53 by the second light-shielding portions 59. The narrowed exit light L is further blocked and inhibited from entering the adjoining icon indicators 53 by the first light-shielding portions 57. More specifically, in the exit light L, the exit light Lb is inhibited from reaching the adjoining icon indicators 53 by the first light-shielding portions 57.

Because the panel portion 21 has the four first light-shielding portions 57 provided between the five icon indicators 53 and the four second light-shielding portions 59 provided between the five light sources 51, leakage of the exit light L coming from the light sources 51 into the adjoining icon indicators 53 is suppressed. Hence, it is possible to prevent unintentional lighting of the adjoining icon indicators 53. The leakage of the exit light L coming from the light sources 51 into the adjoining icon indicators 53 means that, for example, the exit light L coming from the second light source 51 from the +Y-side end does not reach the second icon indicator 53 from the +Y side end, but reaches the first or third icon indicator 53, which adjoins the second icon indicator 53.

Furthermore, in this embodiment, because the first light-shielding portions 57 are located at positions corresponding to the second light-shielding portions 59 when the opening/closing cover 5 is closed, the gaps formed between the first light-shielding portions 57 and the second light-shielding portions 59 are minimum. Hence, the entry of the exit light L into the adjoining icon indicators 53 through the gaps between the first light-shielding portions 57 and the second light-shielding portions 59 is effectively inhibited.

The icon indicators 53 are provided in areas where the exit light L passing through the first walls 73, without passing through the second wall 75*s*, reaches. More specifically, as shown in FIG. 9, in the exit light L, the exit light Lc passing through the first wall 73 without passing through the second wall 75 reaches the icon indicator 53, whereas the exit light Lb passing through the second wall 75 and then through the first wall 73 does not reach the icon indicator 53. Hence, it is possible to prevent variation in the transmission distance, at which the exit light L passes through the cover portions 67, in the exit light L reaching the icon indicators 53. Hence, uneven brightness of the icon indicators 53 due to the variation in the transmission distance, at which the exit light L passes through the cover portions 67, is suppressed.

Other Modifications

It is of course to be understood that the present disclosure is not limited to the above-described embodiment, and various structures can be adopted within a scope not departing from the spirit thereof. For example, the above-described embodiment may be modified as follows. Furthermore, the embodiment and the modifications may be combined.

The first light-shielding portions 57 do not necessarily have to be provided on the cover exterior portion 13, in which the icon indicators 53 are provided, and may be provided on a member other than the cover exterior portion 13. Furthermore, the second light-shielding portions 59 do not necessarily have to be provided on the opening exterior portion 12 and may be provided on a member other than the opening exterior portion 12, i.e., for example, the substrate 61.

The cover portions 67 do not necessarily have to have the first walls 73 and the second walls 75 and may have, for example, only the first walls 73. Also with this structure, the first walls 73 cover the cover openings 71. Hence, the entry of foreign matter into the light sources 51 through the cover openings 71 is suppressed.

Additional Description

The printing device will be additionally described.

A printing device includes: a device body; an opening/closing cover pivotably provided on the device body; a plurality of light sources provided on the device body; a plurality of icon indicators provided in the opening/closing cover at positions corresponding to the plurality of light sources when the opening/closing cover is closed; first light-shielding portions provided on the opening/closing cover at positions between the plurality of icon indicators; and second light-shielding portions provided on the device body at positions between the plurality of light sources.

This structure suppresses leakage of exit light coming from the light sources into adjoining icon indicators.

In this case, the first light-shielding portions may be provided at positions corresponding to the second light-shielding portions when the opening/closing cover is closed.

This structure minimizes gaps formed between the first light-shielding portions and the second light-shielding portions. Hence, it is possible to effectively suppress the entry of the exit light coming from the light sources into adjoining icon indicators through the gaps between the first light-shielding portions and the second light-shielding portions.

In this case, the printing device may further include a plurality of cover portions that cover the plurality of light sources and through which exit light emitted from the light sources passes.

This structure suppresses the entry of foreign matter into the light sources.

In this case, the cover portions may have first walls provided between the light sources and the icon indicators and second walls provided around the light sources, and the icon indicators may be provided in areas reached by the exit light passing through the first walls without passing through the second walls.

This structure suppresses variation in the transmission distance, at which the exit light passes through the cover portions, in the exit light reaching the icon indicators. Hence, it is possible to suppress uneven brightness of the icon indicators due to the variation in the transmission distance, at which the exit light passes through the cover portions.

In this case, the printing device may further include a substrate on which the plurality of light sources are provided. The opening/closing cover may have an operation button, and the substrate may have a switch member that is switched between ON and OFF by the operation button when the opening/closing cover is closed.

In this structure, because the switch member is provided on the substrate provided with the light sources, there is no need to provide multiple substrates, thus achieving a simple structure.

Note that the feed button 19 is an example of the operation button.

In this case, the opening/closing cover may have a non-transmissive portion formed of a non-transmissive material, and a transmissive portion formed of a transmissive material. The non-transmissive portion and the transmissive portion may be formed as a single component, and the icon indicators may be formed of the transmissive portion.

In this structure, because the non-transmissive portion and the transmissive portion are formed as a single component, there is no gap between the non-transmissive portion and the transmissive portion, and thus, dust does not accumulate on the opening/closing cover.

What is claimed is:

1. A printing device comprising:

a device body;

an opening/closing cover pivotably provided on the device body;

a plurality of light sources provided on the device body;

a plurality of icon indicators provided in the opening/closing cover at positions corresponding to the plurality of light sources when the opening/closing cover is closed;

a first light-shielding portion provided on the opening/closing cover at a position between at least one adjoining pair of the plurality of icon indicators; and a substrate on which the plurality of light sources are provided, wherein the opening/closing cover has an operation button, and the substrate has a switch member that is switched between ON and OFF by the operation button when the opening/closing cover is closed.

2. The printing device according to claim 1, further comprising a second light-shielding portion provided on the device body at position between at least one adjoining pair of the plurality of light sources, wherein the first light-shielding portion is provided at position corresponding to the second light-shielding portion when the opening/closing cover is closed.

3. The printing device according to claim 1, further comprising a plurality of cover portions that cover the plurality of light sources and through which exit light emitted from the light sources passes.

4. The printing device according to claim 3, wherein the cover portions have first walls provided between the light sources and the icon indicators and second walls provided around the light sources, and the icon indicators are provided in areas reached by the exit light passing through the first walls without passing through the second walls.

5. The printing device according to claim 1, wherein the opening/closing cover has a non-transmissive portion formed of a non-transmissive material, and a transmissive portion formed of a transmissive material, the non-transmissive portion and the transmissive portion are formed as a single component, and the icon indicators are formed of the transmissive portion.

6. A printing device comprising:

a device body;

an opening/closing cover pivotably provided on the device body;

a plurality of light sources provided on the device body;

a plurality of icon indicators provided in the opening/closing cover at positions corresponding to the plurality of light sources when the opening/closing cover is closed;

a light-shielding portion provided on the device body at position between at least one adjoining pair of the plurality of light sources; and a substrate on which the plurality of light sources are provided, wherein the opening/closing cover has an operation button, and the substrate has a switch member that is switched between ON and OFF by the operation button when the opening/closing cover is closed.

7. The printing device according to claim 6, further comprising a plurality of cover portions that cover the plurality of light sources, and through which exit light emitted from the light sources passes.

8. The printing device according to claim 7, wherein the cover portions have first walls provided between the light sources and the icon indicators and second walls provided around the light sources, and the icon indicators are provided in areas reached by the exit light passing through the first walls without passing through the second walls.

9. The printing device according to claim 6, wherein the opening/closing cover has a non-transmissive portion formed of a non-transmissive material, and a transmissive portion formed of a transmissive material, the non-transmissive portion and the transmissive portion are formed as a single component, and the icon indicators are formed of the transmissive portion.

10. A printing device comprising:

a device body;

an opening/closing cover pivotably provided on the device body;

a plurality of light sources provided on the device body;

a plurality of icon indicators provided in the opening/closing cover at positions corresponding to the plurality of light sources when the opening/closing cover is closed;

a first light-shielding portion provided on the opening/closing cover around at least one part of at least one of the plurality of icon indicators; and a substrate on which the plurality of light sources are provided, wherein the opening/closing cover has an operation button, and the substrate has a switch member that is switched between ON and OFF by the operation button when the opening/closing cover is closed.

11. The printing device according to claim 10, further comprising a plurality of cover portions that cover the plurality of light sources, and through which exit light emitted from the light sources passes.

12. The printing device according to claim 11, wherein the cover portions have first walls provided between the light sources and the icon indicators and second walls provided around the light sources, and the icon indicators are provided in areas reached by the exit light passing through the first walls without passing through the second walls.

13. The printing device according to claim 10, wherein the opening/closing cover has a non-transmissive portion formed of a non-transmissive material, and a transmissive portion formed of a transmissive material, the non-transmissive portion and the transmissive portion are formed as a single component, and the icon indicators are formed of the transmissive portion.

* * * * *